US007971467B2

(12) United States Patent
Yamada

(10) Patent No.: US 7,971,467 B2
(45) Date of Patent: Jul. 5, 2011

(54) STAMPING DEVICE AND STAMPING METHOD

(75) Inventor: Kouji Yamada, Anjo (JP)

(73) Assignee: Toyotomi Kiko Co., Ltd., Anjo-Shi (JP)

( * ) Notice: Subject to any disclaimer, the term of this patent is extended or adjusted under 35 U.S.C. 154(b) by 287 days.

(21) Appl. No.: 12/311,623

(22) PCT Filed: May 30, 2008

(86) PCT No.: PCT/JP2008/060049

§ 371 (c)(1),
(2), (4) Date: Apr. 7, 2009

(87) PCT Pub. No.: WO2009/118918

PCT Pub. Date: Oct. 1, 2009

(65) Prior Publication Data

US 2010/0186476 A1 Jul. 29, 2010

(30) Foreign Application Priority Data

Mar. 28, 2008 (JP) ..... 2008-088282

(51) Int. Cl.
*B21D 31/00* (2006.01)
*B21D 22/00* (2006.01)

(52) U.S. Cl. ..... 72/356; 72/379.2; 72/361

(58) Field of Classification Search ..... 72/348, 72/350, 351, 356, 361, 379.2
See application file for complete search history.

(56) References Cited

U.S. PATENT DOCUMENTS

| | | | | |
|---|---|---|---|---|
| 4,358,263 | A * | 11/1982 | Shiraishi et al. | 425/397 |
| 5,600,991 | A * | 2/1997 | Munzen | 72/348 |
| 6,032,504 | A * | 3/2000 | Onat et al. | 72/297 |
| 6,339,949 | B1 * | 1/2002 | Takamatu | 72/347 |

FOREIGN PATENT DOCUMENTS

| | | |
|---|---|---|
| JP | A 6-304671 | 11/1994 |
| JP | A 8-90093 | 4/1996 |
| JP | A 8-117881 | 5/1996 |
| JP | B2-2532898 | 9/1996 |
| JP | A 9-57381 | 3/1997 |
| JP | A 10-328762 | 12/1998 |
| JP | A 2004-237347 | 8/2004 |
| JP | A 2005-21945 | 1/2005 |

* cited by examiner

*Primary Examiner* — Jimmy T Nguyen
(74) *Attorney, Agent, or Firm* — Oliff & Berridge, PLC

(57) ABSTRACT

The present application provides a technique for simultaneously bending and drawing.
In a stamping device, the timing at which an upper pad moves downward and grips a work piece between the upper pad and a first supporting surface is adjusted so as not to be later than the timing at which an upper bending steel makes contact with the work piece. The height of a lower end of the upper bending steel after the timing at which the upper bending steel has made contact with the work piece, and the height of a lower surface of a drawing pad after the timing at which the work piece has been gripped between the drawing pad and a third supporting surface are adjusted such that the lower end of the upper bending steel and the lower surface of the drawing pad move downward while maintaining the same height at a boundary between the upper bending steel and the drawing pad.

5 Claims, 12 Drawing Sheets

STAMPING DEVICE AND STAMPING METHOD

This is a National Stage Application of PCT Application No. PCT/JP2008/060049 filed May 30, 2008, which claims the benefit of Japanese Patent Application No. JP-2008-088282 filed Mar. 28, 2008. The disclosure of the prior applications is hereby incorporated by reference herein in its entirety.

TECHNICAL FIELD

The present application claims priority to Japanese Patent Application No. 2008-088282 filed on Mar. 28, 2008, the contents of which are hereby incorporated by reference into the present specification.

The present invention relates to a stamping technique. In particular, the present invention relates to a technique wherein a stamping device is utilized to draw and bend an item of work piece simultaneously.

BACKGROUND ART

A stamping device that draws a work piece comprises a punch, a lower pad, and a drawing pad. A work piece to be processed is supported by the punch and a supporting surface of the lower pad. In the stamping device, a peripheral section of the work piece, which is supported by the supporting surface of the lower pad, will be gripped between the lower pad and the drawing pad when the drawing pad is lowered with respect to the punch. From this state, the stamping device draws the work piece by further lowering the drawing pad and the lower pad. The stamping device prevents the work piece from undergoing shearing or undulation, etc. during the drawing process by gripping the peripheral section of the work piece between the lower pad and the drawing pad. The peripheral section of the work piece is provided in order for the stamping device to draw the work piece. The peripheral section of the work piece is a section that is not required in the actual product. The peripheral section of the work piece is thus cut off from the work piece after the drawing process is completed (cf. Patent Document 1).

Patent Document 1: Japanese Patent Application No. 10-328762

DISCLOSURE OF THE INVENTION

Problem to be Solved by the Invention

In order to perform a conventional drawing process, the work piece must be provided with a peripheral section that is not necessary for the shape of the product. As a result, the yield rate of material is worse than that in a bending process.

One idea to deal with this may be to form the required shape on the work piece by the bending process without the drawing process. Unlike the drawing process, the bending process does not require the peripheral section to grip, and consequently it is not necessary to provide the work piece with the peripheral section that is not a required portion of the actual product. For this reason, the yield rate of material is greater in the bending process than in the drawing process. However, unlike in the drawing process, the work piece cannot be processed into complicated shapes in the bending process.

Some stamping products have two portions joined, namely a first portion having a comparatively simple shape, i.e. a shape that can be formed solely by a bending process, and a second portion having a complicated shape that cannot be formed by the bending process. In the case where this type of product is stamped, the yield rate of the material may be increased if a step of bending the first portion and a step of drawing the second portion are separate. However, it is not possible to obtain a product in which the first bent portion and the second drawn portion are joined together smoothly, and therefore this method cannot be adopted. As a result, drawing process also has to be performed on the first portion that can be formed by bending process, and it is thus difficult to increase the yield rate of the material.

The present invention has taken the above situation into consideration, and aims to present a technique for simultaneous bending and drawing.

Means to Solve the Problem

In order to solve the above problem, the stamping device of the present invention comprises a lower bending steel, an upper pad, an upper bending steel, a punch, a lower pad, and a drawing pad. The lower bending steel has a first supporting surface for supporting a work piece. The upper pad is configured to move up and down with respect to the lower bending steel and, by moving downward, grip the work piece between the upper pad and the first supporting surface, thus fixing the position of the work piece. The upper bending steel is configured to move up and down with respect to the lower bending steel. The upper bending steel makes contact with the work piece while moving downward, and bends the work piece between the upper bending steel and the lower bending steel while further moving downward. The punch is apposed to the lower bending steel. The punch has a second supporting surface for supporting the work piece. The punch is configured incapable of moving up and down with respect to the lower bending steel. The lower pad is disposed along a peripheral end of the second supporting surface. The lower pad has a third supporting surface for supporting the work piece. The lower pad is configured to move up and down with respect to the punch. The drawing pad is configured to move up and down with respect to the punch. The drawing pad grips the work piece between the drawing pad and the third supporting surface while moving downward. While the drawing pad moves further downward, the drawing pad draws the work piece that is in a state of being gripped between the drawing pad and the third supporting surface. The work piece is drawn between the punch and the drawing pad with the lower pad being pushed downward.

With this stamping device, the bending process and the drawing process can be performed on the work piece in the same step. Any peripheral section is no longer necessary for a part to bend. It is therefore possible to increase the yield rate of material compared to the case in which the entirety of the work piece is drawn.

However, in the stamping device provided with the mere elements described above, it may not be possible to obtain a work piece in which the bent portion and the drawn portion were smoothly joined together.

In addition to the above-described configuration, the stamping device of the present invention is characterized in being provided with the following configuration.

Configuration (1) The timing at which the upper pad moves downward and grips the work piece between the upper pad and the first supporting surface is adjusted so as not to be later than the timing at which the upper bending steel makes contact with the work piece.

Configuration (2) The height of a lower end of the upper bending steel after the timing at which the upper bending steel has made contact with the work piece, and the height of a lower surface of the drawing pad after the timing at which the work piece has been gripped between the drawing pad and the third supporting surface are adjusted such that the lower end of the upper bending steel and the lower surface of the drawing pad move downward while maintaining the same height at a boundary between the upper bending steel and the drawing pad.

Configuration (1) enables to prevent the work piece from moving during the bending process and the drawing process. Configuration (2) enables to have the timing at which the drawing process begins and the timing at which the bending process begins simultaneously. Further, by adopting the configuration (2), it is possible to draw and bend simultaneously while maintaining the height of the work piece gripped between the drawing pad and the third supporting surface and the height of the work piece making contact with the lower end of the upper bending steel to be at the same level at the boundary between the upper bending steel and the drawing pad. That is, an end portion for the drawing process and an end portion for the bending process meet each other at the same position, and a binary process of the two processes is performed at the boundary of the two processes. According to the stamping device provided with the above described configuration, it is possible to obtain a work piece in which the drawn portion and the bent portion are smoothly joined together.

The work piece to be stamped by this stamping device may be formed into a predetermined shape prior to stamping. The plate thickness of the work piece need not be uniform. In these case, it is preferred that the first supporting surface, the second supporting surface, and the third supporting surface are adjusted so as to have a height that accords with the shape of the work piece. In the case where the work piece processed by the stamping device is a flat plate having a uniform plate thickness, it is preferred that, at the timing at which the upper bending steel makes contact with the work piece, the height of the first supporting surface, the height of the second supporting surface, and the height of the third supporting surface are adjusted so as to be at the same height.

With this configuration, a work piece having a uniform plate thickness may be bent and drawn simultaneously.

The present invention also sets forth a stamping method for bending and drawing simultaneously. The stamping method of the present invention may comprise a mounting step, a positioning step, a bending step, and a drawing step.

In the mounting step, the work piece is mounted on a first supporting surface of a lower bending steel, a second supporting surface of a punch apposed to the lower bending steel and configured incapable of moving up and down with respect to the lower bending steel and a third supporting surface of a lower pad disposed along a peripheral end of the second supporting surface and configured to move up and down with respect to the punch. In the positioning step, the position of the work piece is fixed between an upper pad and the first supporting surface by moving the upper pad downward with respect to the lower bending steel. In the bending step, an upper bending steel is moved downward with respect to the lower bending steel to make contact with the work piece, and the bending process is performed on the work piece between the upper bending steel and the lower bending steel when the upper bending steel is further moved downward. In the drawing step, a drawing pad is moved downward with respect to the punch to grip the work piece between the drawing pad and the third supporting surface, is further moved downward such that the work piece is drawn between the drawing pad and the punch by the lower pad being pushed downward. Consequently, the drawing process is performed on the work piece that is in a state of being gripped between the drawing pad and the third supporting surface.

The positioning step is adjusted so as not to be later than the timing at which the upper bending steel makes contact with the work piece. Further, the height of a lower end of the upper bending steel after the timing at which the upper bending steel has made contact with the work piece, and the height of a lower surface of the drawing pad after the timing at which the work piece has been gripped between the drawing pad and the third supporting surface are adjusted such that the lower end of the upper bending steel and the lower surface of the drawing pad move downward while maintaining the same height at a boundary between the upper bending steel and the drawing pad.

According to the stamping method, it may no longer be necessary to provide a peripheral section on the bent portion of the work piece. It may therefore be possible to increase the yield rate of material compared to the case where the entirety of the work piece is drawn. Further, according to the present stamping method, it may be possible to obtain work piece in which the drawn portion and the bent portion are smoothly joined together.

The work piece to be stamped by the stamping method described above may be a joint piece made of two work pieces: a first work piece composed of high tensile strength material and a second work piece composed of low tensile strength material. In this case, it is preferred that the work piece is put such that the first work piece is supported by the first supporting surface and the second work piece is supported by the second supporting surface and the third supporting surface.

For example, a part utilized in a motor vehicle needs to be light and rigid. For this reason, high tensile strength material is often used in the parts utilized in motor vehicles. This is due to the fact that in a case where a low tensile strength material is used for the manufacture of such rigid part, the plate thickness of the material must be increased, and as its consequence the part becomes heavier. On the other hand, high tensile strength material does not stretch as easily as low tensile strength material, and consequently it is difficult to draw. In the present stamping method as described above, the part is manufactured by utilizing a work piece that is composed of the first work piece composed of high tensile strength material and the second work piece composed of low tensile strength material. The rigidity of the work piece processed by the above described stamping method can therefore be increased compared to the rigidity of the work piece manufactured from low tensile strength material having the same plate thickness. Further, in the above described stamping method, only the second work piece composed of low tensile strength material undergoes the drawing process. As a result, the drawing process can be performed easily. Further, even in a case where the peripheral section of the work piece is to be cut off after the drawing process, this can easily be cut off comparatively neat for the aforesaid end part being made of the low tensile strength material.

In this stamping method, it is preferred that a trimming step is provided prior to the bending step, wherein the trimming step is executed for forming the profile of the first work piece into a required profile.

The shape of the work piece after having been processed by the stamping method may contribute in increasing the rigidity of the work piece. In particular, in the case where the work piece is manufactured from high tensile strength material, the work piece becomes extremely rigid. In a case where the rigidity of the trimmed work piece increases, a large load is applied to the trimming steel utilized in the trimming process. As a result, the durability of the trimming steel decreases, and the trimming steel must be exchanged frequently. According to the present stamping method, it is not necessary to trim the work piece composed of high tensile strength material after the bending process.

With this invention, the amount of work piece cut off in the trimming step after the stamping process can be decreased, and the yield rate of the material is thus increased. The manufacturing cost of the part can thus be decreased.

Some of the technical characteristics of the embodiments described below will be given.

(Feature 1) A lower bending steel may comprise a plurality of positioning protrusions that protrude from a first supporting surface toward an upper pad. A work piece may comprise positioning holes through which the positioning protrusions pass in the state that the work piece is being supported on the first supporting surface. In a positioning step, the work piece may be on the stamping device with its positioning protrusions passing through positioning holes of the work piece.

EMBODIMENTS

Figure 1:
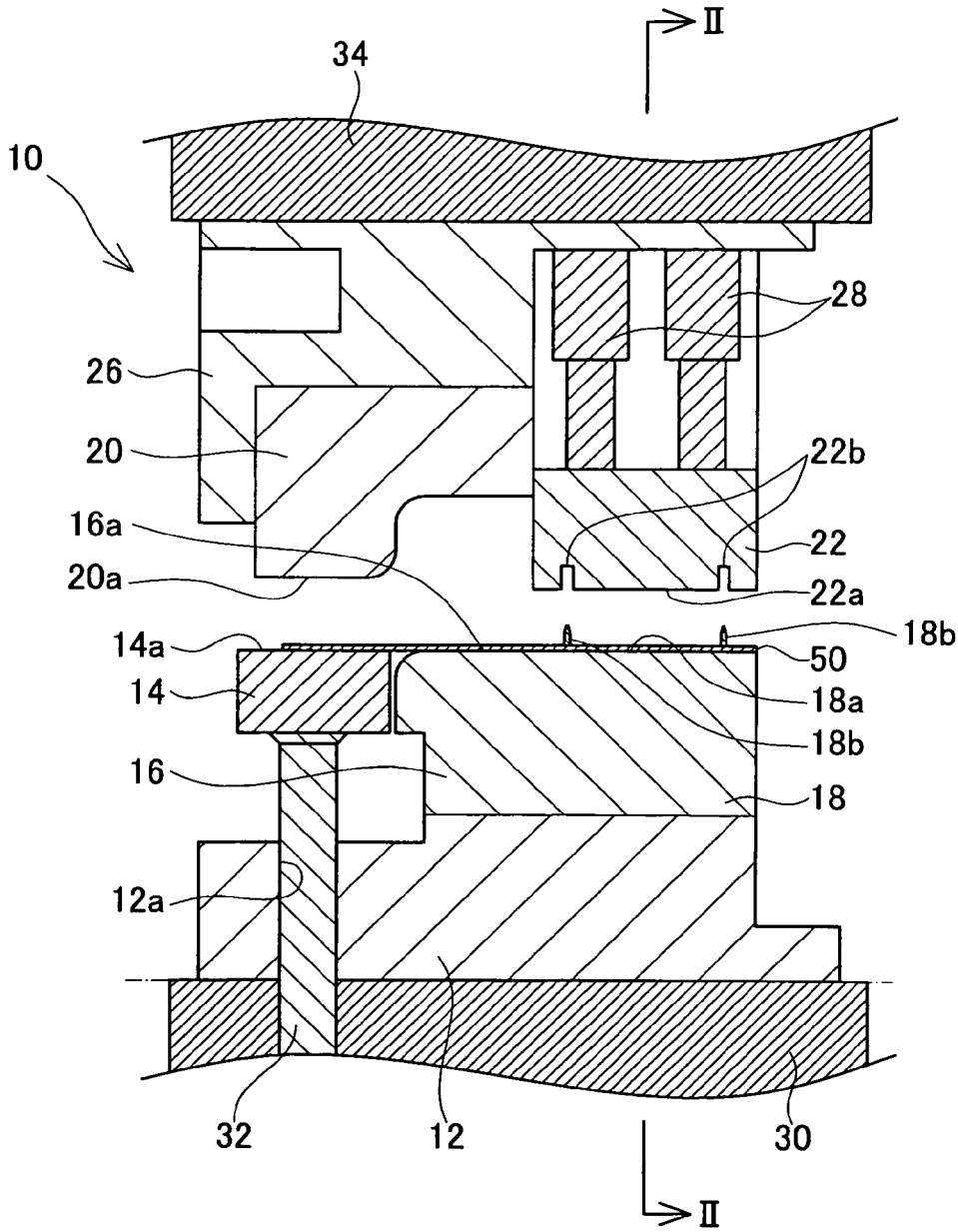
FIG. 1 shows a vertical cross-sectional view of a stamping device.
Figure 2:
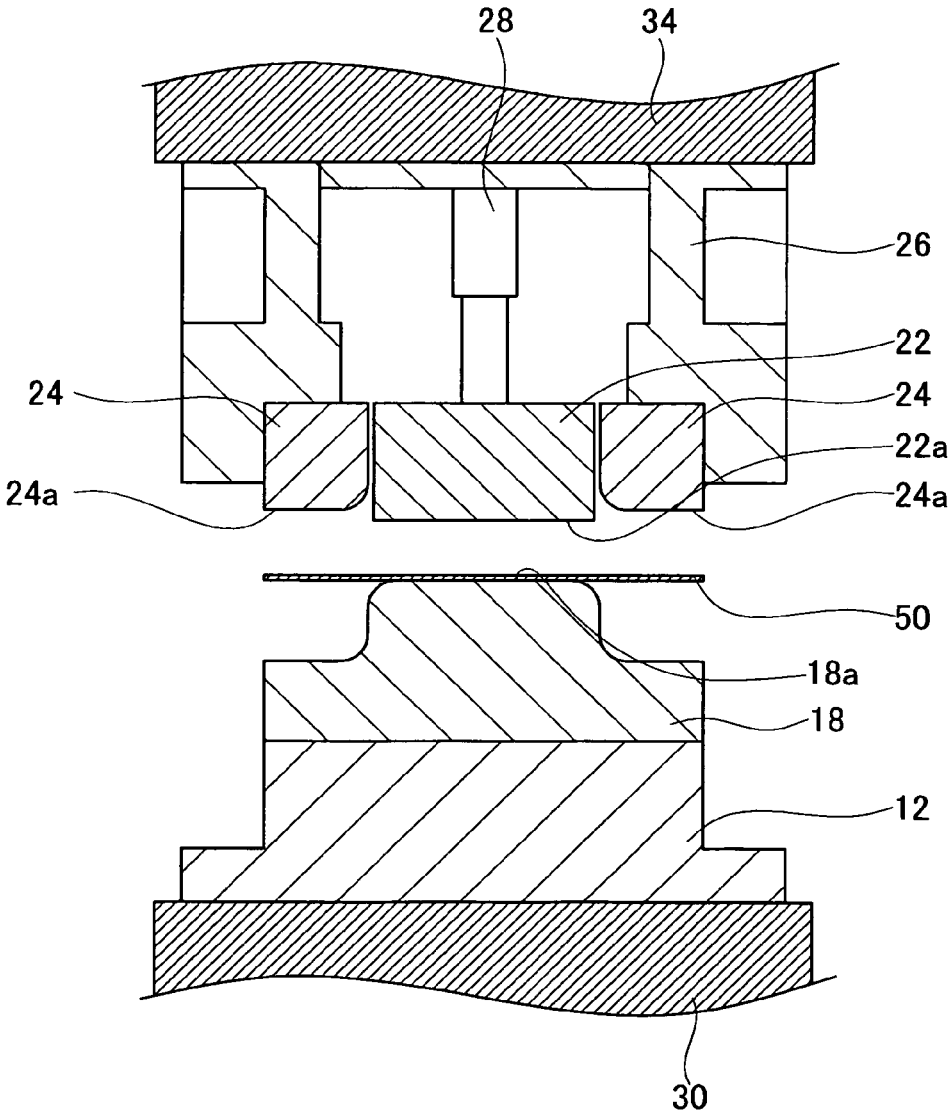
FIG. 2 shows a cross-sectional view along the line II-II of FIG. 1.
Figure 3:
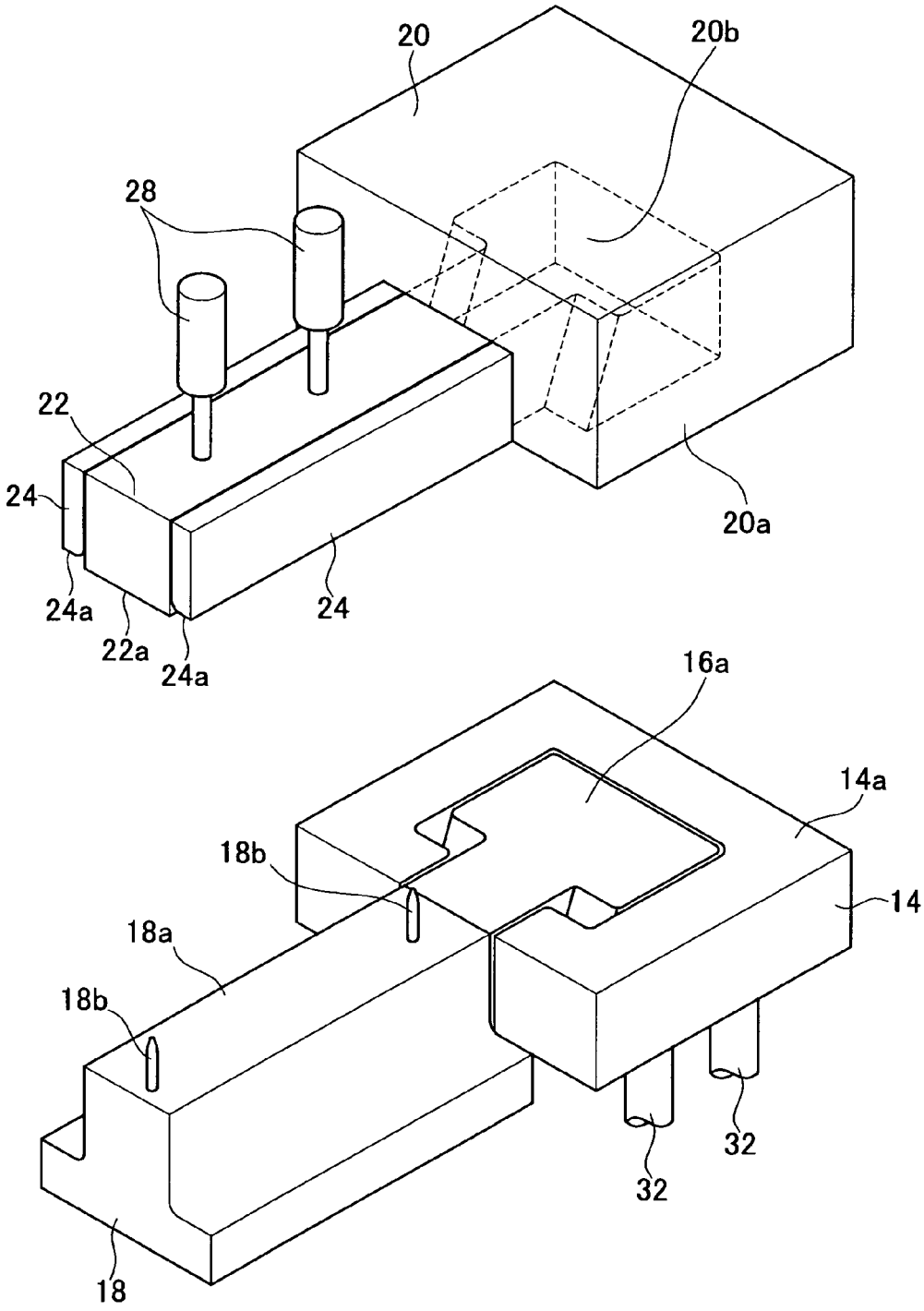
FIG. 3 shows a perspective view for describing the schematic configuration of the stamping device.

An embodiment of a stamping device in which the present invention may be realized will be described with reference to figures. FIG. 1 shows a vertical cross-sectional view of a stamping device 10 of the present embodiment. FIG. 1 shows a state prior to the stamping device 10 performing processing of work piece 50. FIG. 2 shows a cross-sectional view along the line II-II of FIG. 1. FIG. 3 shows a perspective view for describing the configuration of the stamping device 10. As shown in FIGS. 1 and 2, the stamping device 10 comprises a lower die 12, a punch 16, a lower bending steel 18, a cushion pad (lower pad) 14, an upper die 26, an upper pad 22, a drawing pad 20, an upper bending steel 24, and a nitrogen gas cylinder 28.

The lower die 12 is fixed on a bolster 30 of a stamping machine (not shown). A plurality of pin holes 12*a* through which cushion pins 32 of the stamping machine pass are formed in the lower die 12. The punch 16 and the lower bending steel 18 are fixed to an upper surface of the lower die 12. The punch 16 and the lower bending steel 18 are formed integrally. A second supporting surface 16*a* for supporting the work piece 50 is formed at an upper end of the punch 16. A first supporting surface 18*a* for supporting the work piece 50 is formed at an upper end of the lower bending steel 18. The second supporting surface 16*a* and the first supporting surface 18*a* are formed at the same height over an upper surface of the bolster 30. Alternately, the punch 16 and the lower bending steel 18 can be formed separately. Further, two positioning pins 18*b* protrude substantially perpendicular from the first supporting surface 18*a*.

As shown in FIG. 3, the cushion pad 14 is disposed along a peripheral end of the second supporting surface 16*a*. A third supporting surface 14*a* for supporting the work piece 50 is formed at an upper end of the cushion pad 14. The cushion pad 14 is supported by the cushion pins 32 so as to move up and down along the punch 16. The cushion pad 14 moves downward when a load is applied thereto from above, and moves upward when the load is removed. In the state prior to the stamping device 10 stamping the work piece 50, the third supporting surface 14*a* is disposed at the same height as the second supporting surface 16*a*. That is, in the state prior to the stamping, the second supporting surface 16*a*, the first supporting surface 18*a*, and the third supporting surface 14*a* are disposed at the same height and thus thereby leveling.

As shown in FIG. 1, the upper die 26 is fixed to a ram 34 of the stamping machine. The ram 34 is moved up and down with respect to the bolster 30 by the stamping machine. The ram 34 is disposed parallel to the bolster 30. The ram 34 is moved up and down while being maintained parallel to the bolster 30. The upper pad 22 is attached via the nitrogen gas cylinder 28 to a lower surface of the upper die 26. The upper pad 22 is capable of moving up and down along the upper die 26 by expansion and contraction of the nitrogen gas cylinder 28. A first pressing surface 22*a* is formed at a lower end of the upper pad 22. The first pressing surface 22*a* is facing the first supporting surface 18*a* of the lower bending steel 18. Escape holes 22*b* are formed in the first pressing surface 22*a* in positions facing the positioning pins 18*b*.

The drawing pad 20 is fixed to the lower surface of the upper die 26. A second pressing surface 20*a* is formed at a lower end of the drawing pad 20. The second pressing surface 20*a* is facing the third supporting surface 14*a* of the cushion pad 14. As shown in FIG. 2, two upper bending steels 24 are fixed to the lower surface of the upper die 26. The two upper bending steels 24 are positioned so as to face one another. The upper pad 22 is disposed between the two upper bending steels 24. As shown in FIG. 3, the upper bending steels 24 are disposed along a longitudinal direction of the upper pad 22. A lower surface 24*a* of the upper bending steel 24 is disposed at the same height as the second pressing surface 20*a* of the drawing pad 20. The lower surface 24*a* is continuous to the second pressing surface 20*a*. Further, in the state prior to the stamping, the first pressing surface 22*a* of the upper pad 22 is positioned lower than the lower surface 24*a* and the second pressing surface 20*a*.

Figure 4:
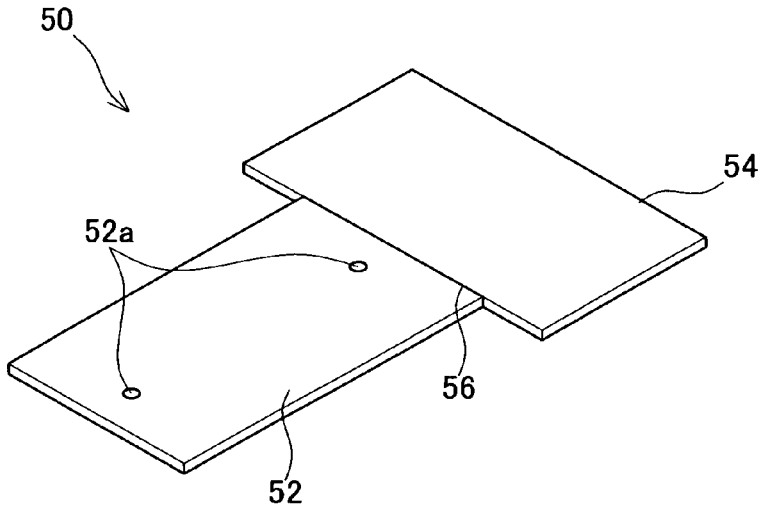
FIG. 4 shows a perspective view of a work piece.
Figure 5:
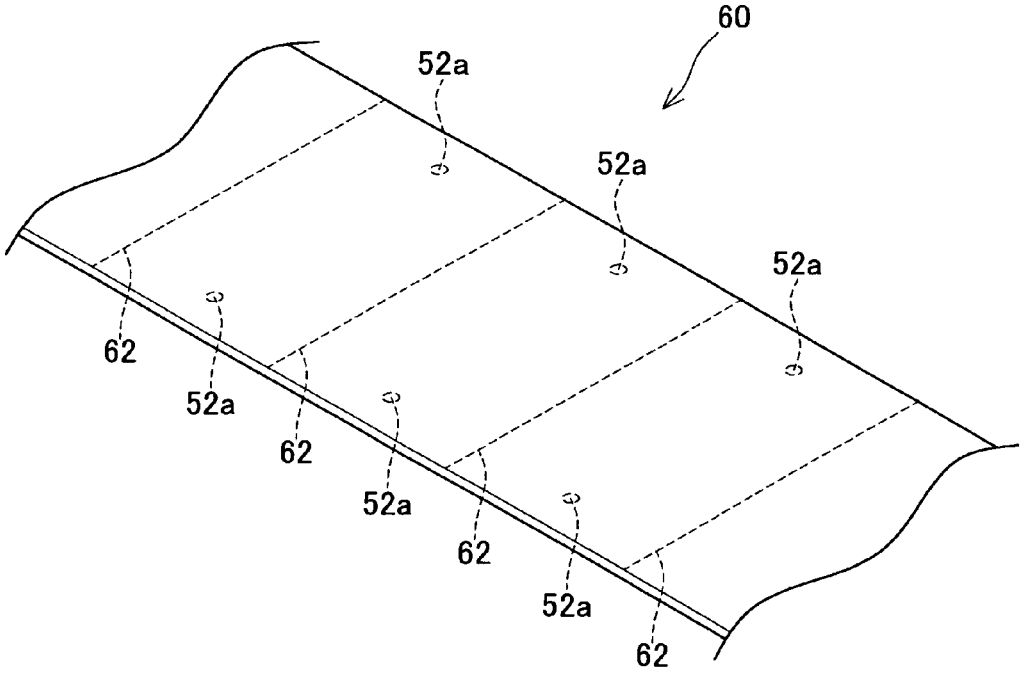
FIG. 5 shows a perspective view of a steel plate for manufacturing the work piece.

FIG. 4 shows a perspective view of the work piece 50. The work piece 50 comprises a first work piece 52 and a second work piece 54. The first work piece 52 and the second work piece 54 are joined by a junction portion 56 by laser joining or the like. The first work piece 52 is manufactured, for example, from high tensile strength steel material that has tensile strength of 980 MPa. The first work piece 52 is a rectangular flat plate. As shown in FIG. 5, the first work piece 52 is manufactured by trimming a steel plate 60 at the positions of broken lines 62 before the first work piece 52 is joined with the second work piece 54. The width of the steel plate 60 is the same as the length in a longitudinal direction of the first work piece 52. The distance between the broken lines 62 is determined such that the first work piece 52 can have a desired profile when it is bent. The profile can be made in some other way. For example, by cutting the steel plate 60 with other stamping devices, or a laser, etc. Positioning holes 52*a* are formed in the first work piece 52 at positions corresponding to the positioning pins 18*b*. The positioning holes 52*a* are formed simultaneously with the trimming process. Diameter of the positioning holes 52*a* is substantially the same as the outer diameter of the positioning pins 18*b*. The length of the first work piece 52 in the longitudinal direction is substantially the same as the length in a longitudinal direction of the first supporting surface 18*a*. The length of the first work piece 52 in a widthwise direction is longer than the length in a widthwise direction of the first supporting surface 18*a*.

The second work piece 54 is manufactured, for example, from low tensile strength steel material that has a lower tensile strength than the first work piece 52. For example, the second work piece 54 is manufactured from steel material that has tensile strength of 590 MPa or below. The second work piece 54 is a rectangular flat plate. The plate thickness of the second work piece 54 is the same as the plate thickness of the first work piece 52.

Next, the method of the stamping device 10 stamping the work piece 50 will be described. First, the work piece 50 is put on the first supporting surface 18*a*, the second supporting surface 16*a*, and the third supporting surface 14*a*. The work piece 50 is put with the positioning pins 18*b* being passed through the positioning holes 52*a*. The work piece 50 is thus fixed in position in the stamping device 10. In a state that the work piece 50 has been placed in position, the junction portion 56 is positioned at a boundary between the punch 16 and the lower bending steel 18. That is, the first work piece 52 is supported by the first supporting surface 18*a*, and the second work piece 54 is supported by the second supporting surface 16*a* and the third supporting surface 14*a*.

When the stamping machine is operated, the ram 34 moves downward with respect to the bolster 30 from the position shown in FIG. 1. The upper die 26 moves downward toward the lower die 12. The drawing pad 20 and the upper bending steel 24 move downward with the movement downward of the upper die 26 at the same speed. The work piece 50 is fixed in position by being gripped between the first pressing surface 22*a* and the first supporting surface 18*a*. When the upper die 26 moves further downward from this position, the nitrogen gas cylinder 28 contracts. Therefore the upper pad 22 is not moved downward. The work piece 50 is fixed firmly in place by the restoring force of the nitrogen gas cylinder 28.

Figure 6:
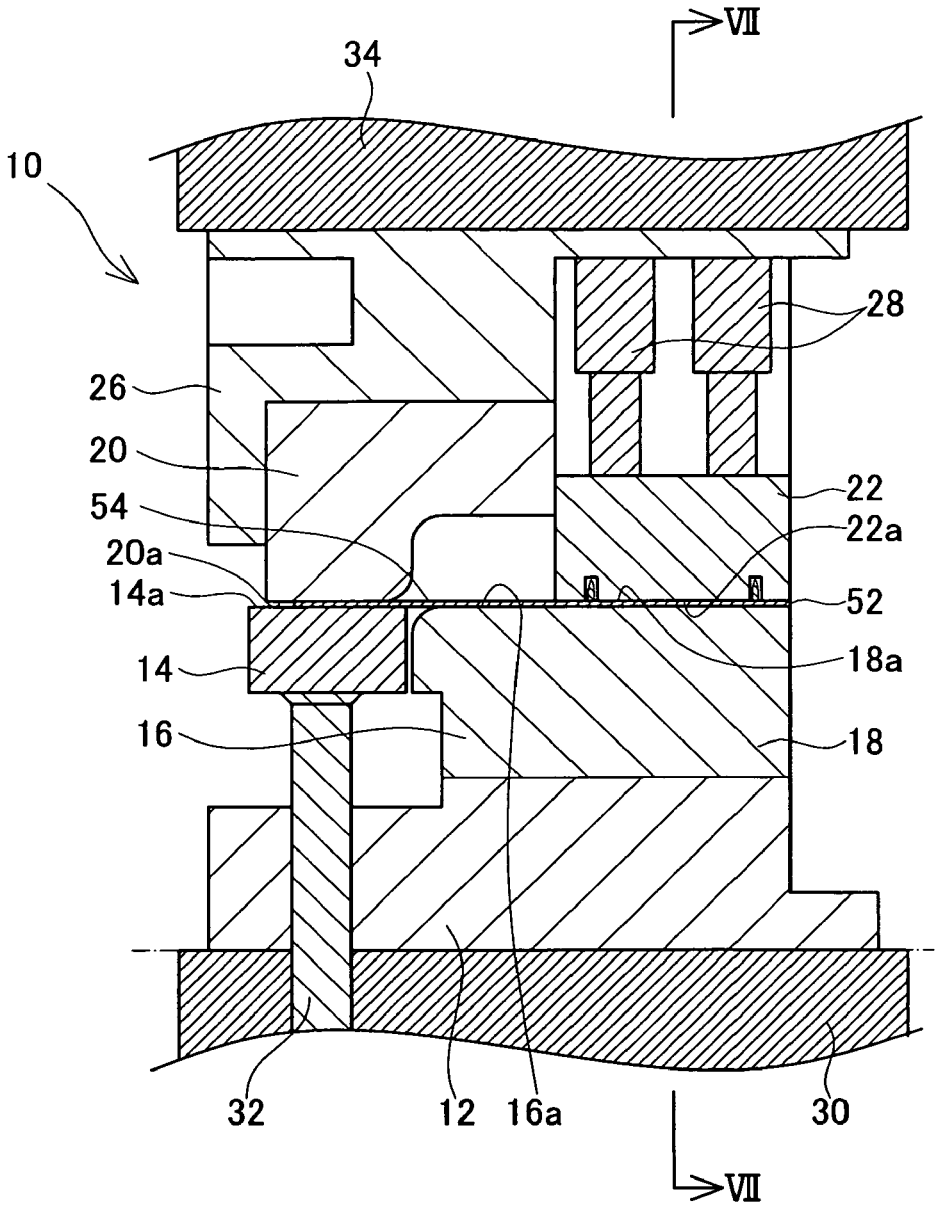
FIG. 6 shows a vertical cross-sectional view of a pressing process beginning state of the stamping device.
Figure 7:
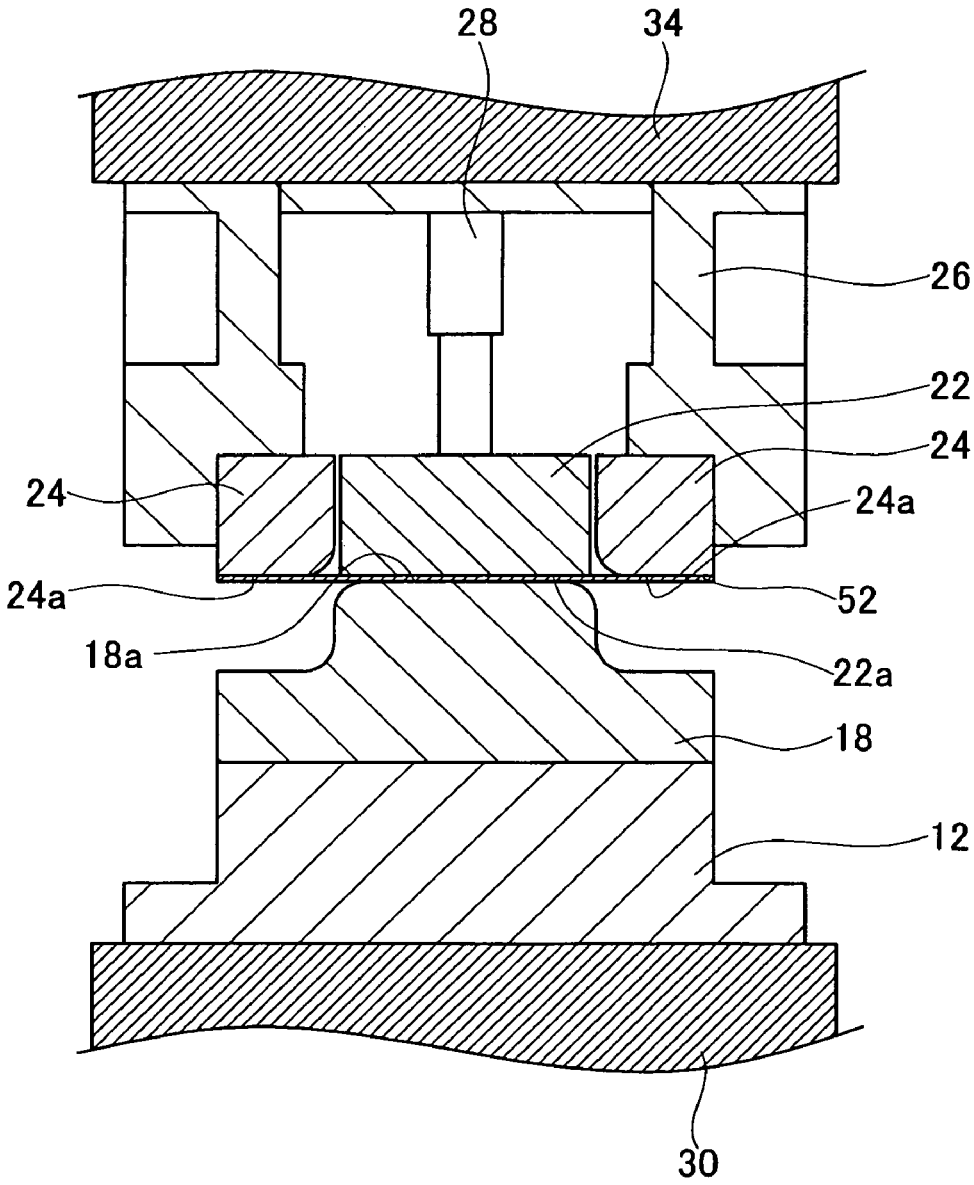
FIG. 7 shows a cross-sectional view along the line VII-VII of FIG. 6.

FIG. 6 shows a vertical cross-sectional view of the stamping device 10 in a case where the upper die 26 has moved downward and the portion of the second work piece 54 supported by the third supporting surface 14*a* is gripped between the second pressing surface 20*a* and the third supporting surface 14*a*. FIG. 7 shows a cross-sectional view along the line VII-VII of FIG. 6. As shown in FIG. 7, the lower surface 24*a* of the upper bending steel 24 makes contact with the first work piece 52 at the same time as the second work piece 54 is gripped between the second pressing surface 20*a* and the third supporting surface 14*a*. The second pressing surface 20*a* and the lower surface 24*a* are positioned at the same height with respect to the work piece 50. As a result, the height of the second pressing surface 20*a* is, at a timing when the second pressing surface 20*a* has made contact with the second work piece 54, positioned at the same height as the lower surface 24*a* is at a timing when the lower surface 24*a* has made contact with the first work piece 52.

When the upper die 26 moves further downward from the state shown in FIG. 7, the first work piece 52 is bent between the lower bending steel 18 and the upper bending steel 24. Simultaneously, the second work piece 54 is drawn between the drawing pad 20 and the punch 16.

Figure 8:
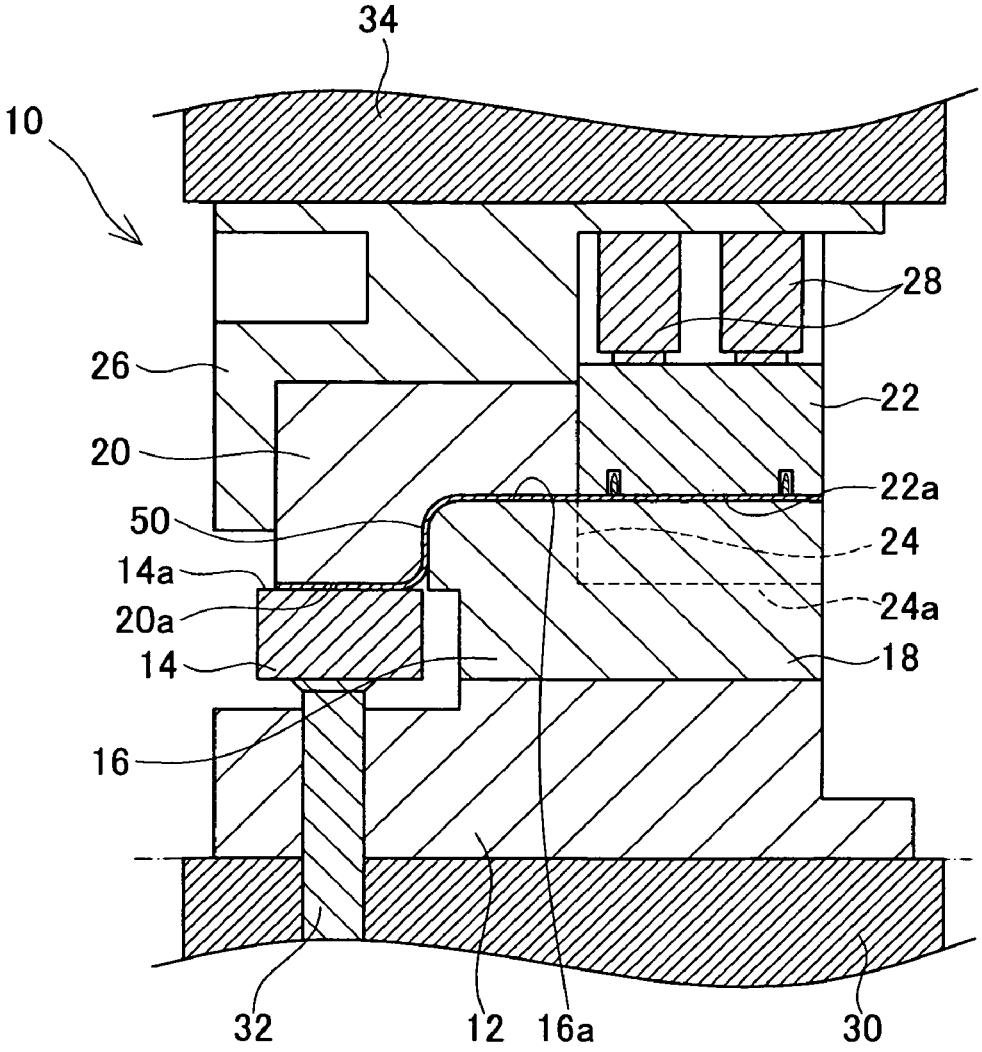
FIG. 8 shows a vertical cross-sectional view of the stamping device at the bottom dead center.

FIG. 8 shows a vertical cross-sectional view of the stamping device 10 at bottom dead center. The drawing pad 20 and the upper bending steel 24 move downward at the same speed from the state of FIG. 7 to the state of FIG. 8. While the stamping device 10 is stamping the work piece 50, it thereby maintains the second pressing surface 20*a* and the lower surface 24*a* at the same height.

In a state that the ram 34 have reached bottom dead center, the position of the cushion pins 32 is fixed by a lock mechanism (not shown) of the stamping machine. After the process of the ram 34 moving downward to bottom dead center ends, the upper die 26 rises together with the ram 34 rising. After the upper pad 22 is raised to a position where it does not make contact with the work piece 50 even if the cushion pins 32 are released from the locked state and move upward, then the cushion pins 32 are released from the locked state and the work piece 50 is raised by the cushion pad 14.

Figure 9:
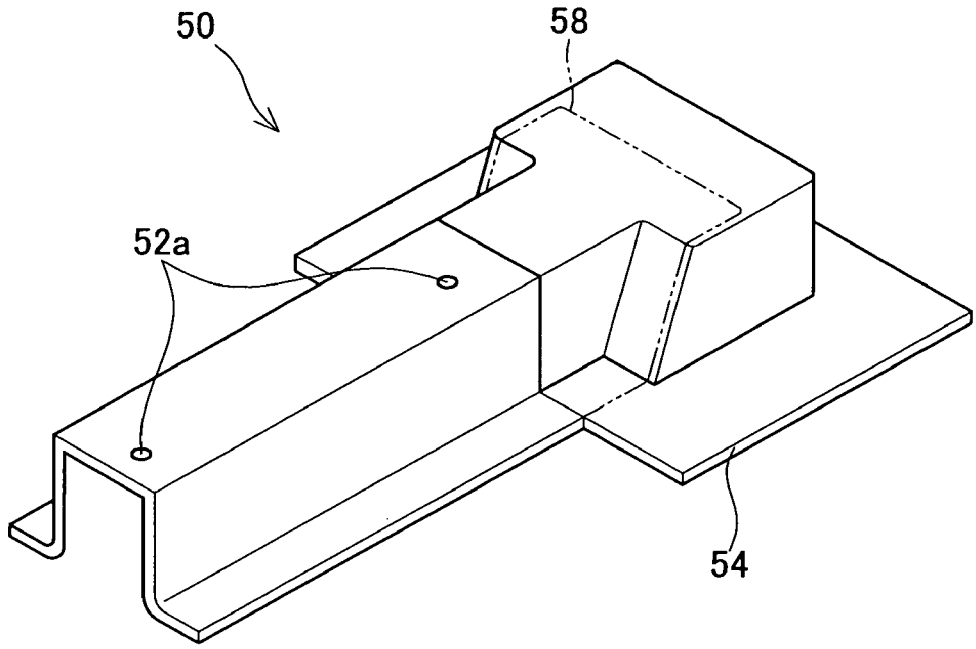
FIG. 9 shows a perspective view of the work piece processed by the stamping device.

FIG. 9 shows a perspective view of the work piece 50 after stamping. The work piece 50 is composed of the first bent work piece 52 and the second drawn work piece 54. After the stamping ends, the second work piece 54 trims at the positions shown by broken lines 58.

With the above described stamping device 10, the bending process and the drawing process can be performed simultaneously on the work piece 50. The yield rate of the material can be increased compared to the case in which the entirety of the work piece 50 is drawn.

In the stamping device 10 described above, the second supporting surface 16*a*, the first supporting surface 18*a*, and the third supporting surface 14*a* are disposed at the same height in the state prior to processing. The work piece 50 is supported by the second supporting surface 16*a*, the first supporting surface 18*a*, and the third supporting surface 14*a*. Further, the second pressing surface 20*a* of the drawing pad 20 and the lower surface 24*a* of the upper bending steel 24 are leveled at the same height. As a result, the lower surface 24*a* and the second pressing surface 20*a* are disposed at the same height with respect to the work piece 50. The timing at which the lower surface 24*a* makes contact with the first work piece 52 when the upper die 26 moves downward is the simultaneous to the timing at which the second pressing surface 20*a* makes contact with the second work piece 54. That is, the timing at which the upper bending steel 24 makes contact with the first work piece 52 is the same as the timing at which the second work piece 54 is gripped between the drawing pad 20 and the cushion pad 14. The timing at which the bending process of the first work piece 52 begins can thus be made simultaneous with the timing at which the drawing process of the second work piece 54 begins.

Further, the height of the lower surface 24*a* is at the time when the upper bending steel 24 makes contact with the first work piece 52 is the same as the height of the second pressing surface 20*a* is at the time when the second work piece 54 being gripped between the second pressing surface 20*a* and the third supporting surface 14*a*. Further, the speed at which the upper bending steel 24 moves downward is the same as the speed at which the drawing pad 20 moves downward. The drawing process and the bending process can thus be performed simultaneously while the second pressing surface 20*a* and the lower surface 24*a* are maintained at the same height. That is, where an end section for the drawing and an end section for the bending meet each other, a process composed of the two processes is performed at the boundary between the two sections. The stamping device 10 can realize a work piece 50 with its first work piece 52 and second work piece 54 joined smoothly after the process.

Further, with the above described stamping device 10, the positioning pins 18*b* are arranged on the first supporting surface 18*a* of the lower bending steel 18. The positioning holes 52*a* are formed in the work piece 50 at positions corresponding to the positioning pins 18*b*. The positioning holes 52*a* is formed substantially the same diameter as the outer diameter of the positioning pins 18*b*. The positioning pins 18*b* and the positioning holes 52*a* prevent the misalignment of the work piece 50 mounted on the first supporting surface 18*a*, the second supporting surface 16*a*, and the third supporting surface 14*a*.

As mentioned, the above described stamping device 10 bends the first work piece 52 and draws the second work piece 54. The load applied to the trimming steel to trim the second work piece 54 after the drawing process is less than that to trim high tensile strength steel such as the first work piece 52, since the second work piece 54 is made of low tensile strength steel, even if the rigidity of the second work piece 54 is increased due to its drawn shape. On the other hand, the profile of the first work piece 52 is shaped by the trimming process before the first work piece 52 undergoes processing by the stamping device 10. As a result, the first work piece 52 that comprises of high tensile strength steel material does not need to trim after being processed by the stamping device 10. It is thus possible to prevent a reduction in durability of the trimming steel used in the trimming process after the stamping has been performed. Further, since the trimming process is performed on the second work piece 54 that comprises of low tensile strength steel material, it is possible to perform neat trimming comparatively easily.

According to the above described stamping device 10, when the ram 34 rises from the bottom dead center, the upper die 26 rises together with the rising ram 34. The upper pad 22 does not move from the state of FIG. 8 until the nitrogen gas cylinder 28 returns to its natural length. The work piece 50 remains fixed between the first pressing surface 22*a* and the first supporting surface 18*a*. On the other hand, the drawing pad 20 rises together with the rising upper die 26. When the ram 34 reaches the bottom dead center, the position of the cushion pins 32 is fixed. The cushion pins 32 is kept fixed until the upper pad 22 has been raised high enough to a position where it does not make contact with the work piece 50 even if the cushion pins 32 are released from the locked state and the work piece 50 is raised by the cushion pad 14. With this configuration, deformation of the work piece 50 can be prevented, because the cushion pad 14 will no longer push the work piece 50 upward while the first work piece 52 is kept fixed. Further, when the work piece 50 is pushed upward by the cushion pad 14, the work piece 50 can be prevented from being deformed due to making contact with the upper pad 22.

(First Variant)

Figure 10:
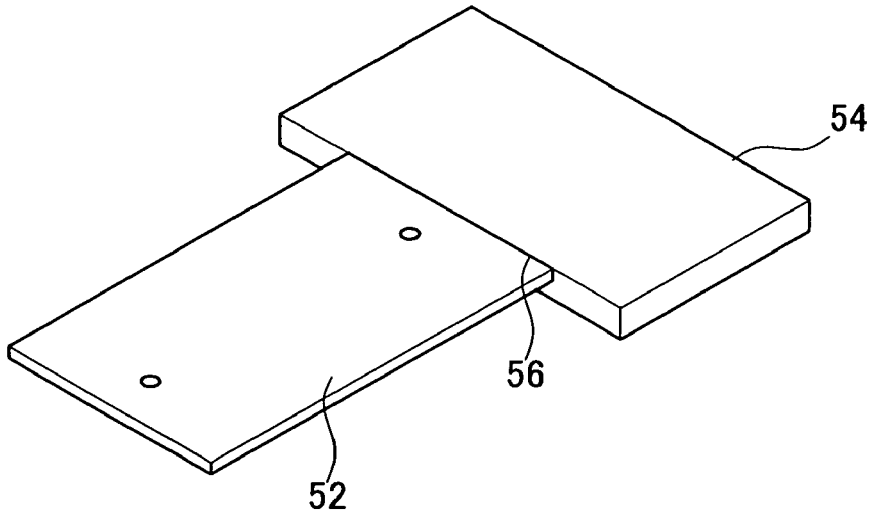
FIG. 10 shows a perspective view of a work piece of a first variant.
Figure 11:
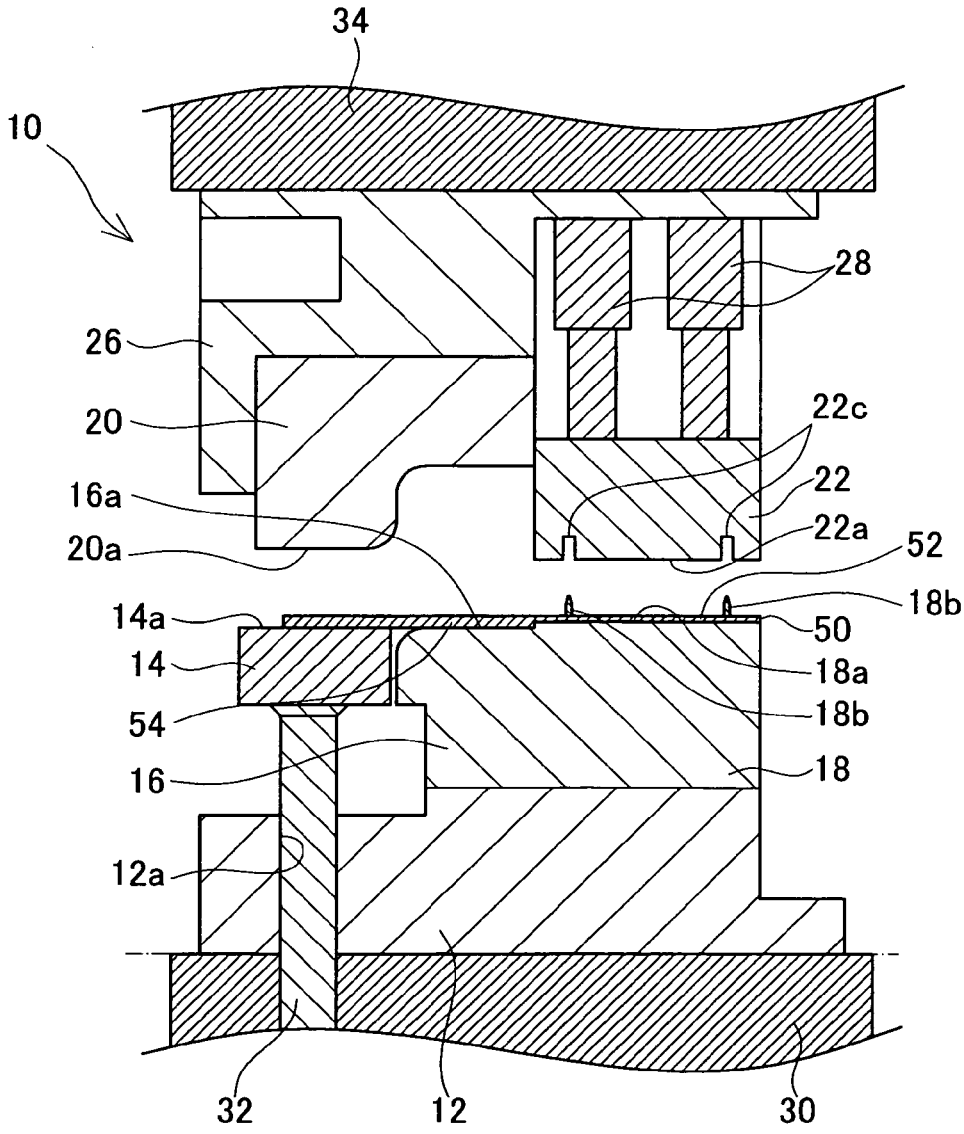
FIG. 11 shows a vertical cross-sectional view of a stamping device of the first variant.

In the embodiment described above, the plate thickness of the first work piece 52 and the second work piece 54 is the same. However, the plate thickness of the first work piece 52 and the second work piece 54 may differ. As shown in FIG. 10, in the case where the plate thickness of the second work piece 54 is greater than the plate thickness of the first work piece 52, the first work piece 52 and the second work piece 54 are preferably joined to make an either surface of them a leveled, integral plane surface. In this case, as shown in FIG. 11, in the stamping device 10, the height of the second supporting surface 16*a* and the third supporting surface 14*a* is adjusted to be lower than the first supporting surface 18*a*; this difference in height being equivalent to the height difference in the plate thickness. As a result, the height of the second pressing surface 20*a* of the drawing pad 20 and the lower surface 24*a* of the upper bending steel 24 is kept at the same height as an upper surface of the work piece 50 placed on the second supporting surface 16*a*, the first supporting surface 18*a*, and the third supporting surface 14*a*. The stamping device 10 is thus capable of starting the drawing process and the bending process at the same time and at the same height level.

(Second Variant)

Figure 12:
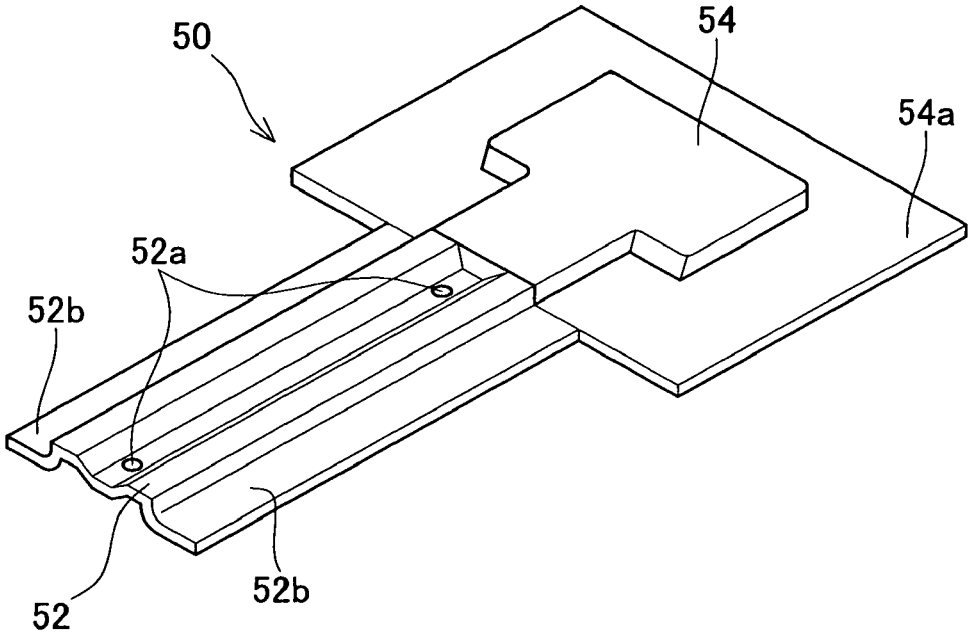
FIG. 12 shows a perspective view of a work piece of a second variant.

In the embodiment described above, both the first work piece 52 and the second work piece 54 had been rectangular flat plates. However, as shown in FIG. 12, the first work piece 52 and the second work piece 54 can be stamped in advance. In this case, they are performed to have a first region 52*b* of the first work piece 52 and a second region 54*a* of the second work piece 54 are on the same plane. The first region 52*b* is a region that makes contact with the lower surface 24*a* of the upper bending steel 24. Meanwhile, the second region 54*a* is a region gripped between the cushion pad 14 and the drawing pad 20. In this case, when the work piece 50 has been set on the second supporting surface 16*a*, the first supporting surface 18*a* and the third supporting surface 14*a* in the stamping device 10, the height of the first region 52*b* and the second region 54*a* is adjusted so as to level at the same height as the second pressing surface 20*a* of the drawing pad 20 and the lower surface 24*a*. The stamping device 10 is thus capable of starting the drawing process and the bending process at the same time and at the same height.

(Third Variant)

Figure 13:
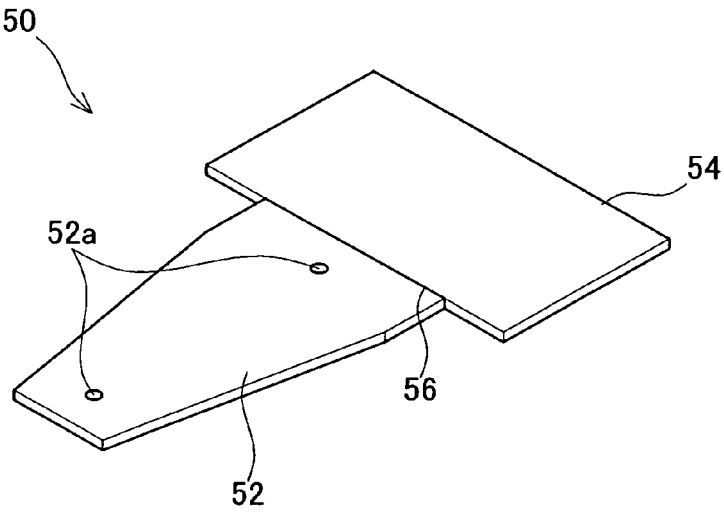
FIG. 13 shows a perspective view of a work piece of a third variant.
Figure 14:
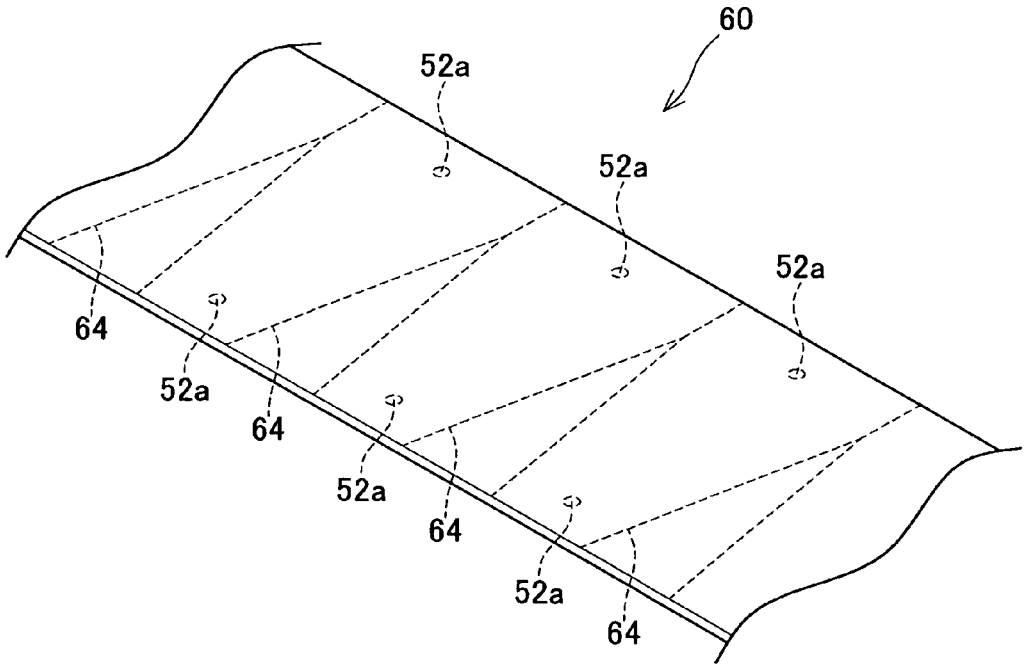
FIG. 14 shows a perspective view of a steel plate for manufacturing the work piece of the third variant.
Figure 15:
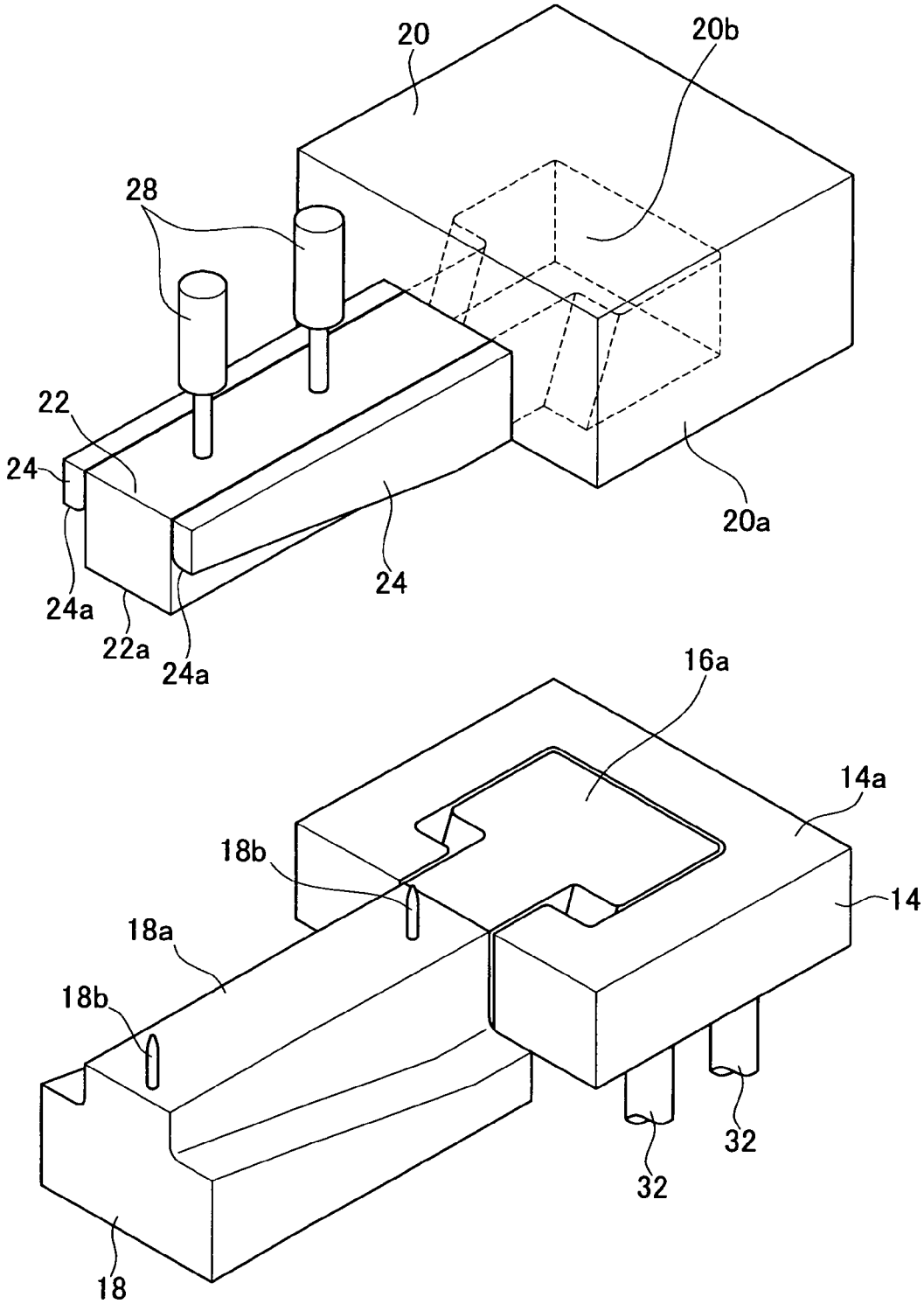
FIG. 15 shows a perspective view for describing parts of the stamping device of the third variant.

In the above described embodiment, both the first work piece 52 and the second work piece 54 had been rectangular flat plates. However, the first work piece 52 and the second work piece 54 need not be rectangular. FIG. 13 shows a perspective view of an example of the work piece 50 in the case where the first work piece 52 is not a rectangular flat plate. In this case, as shown in FIG. 14, the first work piece 52 may be manufactured by performing an external punching process of the steel plate 60 at the positions of broken lines 64 before the first work piece 52 is joined with the second work piece 54. Alternatively, the first work piece 52 may be manufactured by performing the external punching process after the first work piece 52 has been joined with the second work piece 54. As shown in FIG. 15, in the stamping device 10, the lower surface 24*a* of the upper bending steel 24 may be oblique to the second pressing surface 20*a* in accordance with the shape of the first work piece 52. The height of the lower surface 24*a* and the second pressing surface 20*a* is adjusted so as to be leveling at the same height at the boundary between the upper bending steel 24 and the drawing pad 20.

With this configuration, the drawing process and the bending process can be performed simultaneously while the second work piece 54 that has been gripped between the second pressing surface 20*a* and the third supporting surface 14*a*, and the first work piece 52 that has been making contact with the lower end of the upper bending steel 24 are maintained at the same height at the boundary between the upper bending steel 24 and the drawing pad 20. This configuration can realize a work piece whose drawn portion and bent portion are smoothly joined together. The shape of the first work piece 52 and the second work piece 54 can be selected as desired in accordance with the shape for later process.

Specific examples of the present invention have been described in detail above. However, these are merely examples, and do not limit the scope of the claims. The specific examples illustrated above include various modifications and changes that are within the technology disclosed in the present scope of the claims.

For example, the work piece 50 may be manufactured from a uniform material and with a uniform plate thickness. In this case, the work piece 50 need not be manufactured utilizing laser joining, etc. but may be manufactured from one steel plate.

Further, for example, a spring or a urethane spring may be utilized instead of the nitrogen gas cylinder 28.

Further, for example, the cushion pins 32 need not be provided. In this case, a configuration that supports the cushion pad 14 so as to allow the cushion pad 14 to move up and down with respect to the punch 16 (for example, a nitrogen gas cylinder, etc.) may be disposed on the lower die 12. Further, for example, the stamping machine need not be provided with a lock mechanism. In this case, a configuration that slows the rise of the cushion pad 14 with respect to the rise of the ram 34 (for example, a damper, etc.) may be provided.

In addition, the technological components described in the present specification or drawings exhibit technological utility either individually or in various combinations, and are not limited to the combinations disclosed in the claims at the time of application. Furthermore, the technology illustrated in the present specification or the drawings may simultaneously achieve a plurality of objects, and has technological utility by achieving one of those objects.

The invention claimed is:

1. A stamping device comprising:

a lower bending steel having a first supporting surface for supporting a work piece:

an upper pad configured to move up and down with respect to the lower bending steel and, by moving downward, grip the work piece between the upper pad and the first supporting surface and fix the position of the work piece;

an upper bending steel configured to move up and down with respect to the lower bending steel, make contact with the work piece while moving downward, and bend the work piece between the upper bending steel and the lower bending steel while further moving downward;

a punch apposed to the lower bending steel, having a second supporting surface for supporting the work piece and configured to be incapable of moving up and down with respect to the lower bending steel;

a lower pad disposed along a peripheral end of the second supporting surface, having a third supporting surface for supporting the work piece, and configured to move up and down with respect to the punch; and a drawing pad configured to move up and down with respect to the punch, grip the work piece between the drawing pad and the third supporting surface while moving downward and draw the work piece that is in a state of being gripped between the drawing pad and the third supporting surface by further moving downward and the work piece is drawn between the punch and the drawing pad by pushing the lower pad further downward, wherein:

the timing at which the upper pad moves downward and grips the work piece between the upper pad and the first supporting surface is adjusted so as not to be later than the timing at which the upper bending steel makes contact with the work piece, and the height of a lower end of the upper bending steel after the timing at which the upper bending steel has made contact with the work piece and the height of a lower surface of the drawing pad after the timing at which the work piece has been gripped between the drawing pad and the third supporting surface are adjusted such that the lower end of the upper bending steel and the lower surface of the drawing pad move downward while maintaining the same height at a boundary between the upper bending steel and the drawing pad.

2. The stamping device according to claim 1, wherein at the timing at which the upper bending steel makes contact with the work piece, the height of the first supporting surface, the height of the second supporting surface and the height of the third supporting surface are adjusted so as to be at the same height.

3. A stamping method comprising:

a mounting step of mounting a work piece on a first supporting surface of a lower bending steel, a second supporting surface of a punch apposed to the lower bending steel and configured to be incapable of moving up and down with respect to the lower bending steel and a third supporting surface of a lower pad disposed along a peripheral end of the second supporting surface and configured to move up and down with respect to the punch;

a positioning step of positioning the work piece between an upper pad and the first supporting surface by moving the upper pad downward with respect to the lower bending steel;

a bending step of bending the work piece by moving an upper bending steel downward with respect to the lower bending steel to make contact with the work piece and further moving the upper bending steel downward, whereby the bending process is performed on the work piece between the upper bending steel and the lower bending steel; and a drawing step of drawing the work piece by moving a drawing pad downward with respect to the punch to grip the work piece between the drawing pad and the third supporting surface and further moving the drawing pad downward such that the work piece is drawn between the drawing pad and the punch by the lower pad being pushed downward, whereby the drawing process is performed on the work piece that is in a state of being gripped between the drawing pad and the third supporting surface, wherein the positioning step is adjusted so as not to be later than the timing at which the upper bending steel makes contact with the work piece, and the height of a lower end of the upper bending steel after the timing at which the upper bending steel has made contact with the work piece and the height of a lower surface of the drawing pad after the timing at which the work piece has been gripped between the drawing pad and the third supporting surface, are adjusted such that the lower end of the upper bending steel and the lower surface of the drawing pad move downward while maintaining the same height at a boundary between the upper bending steel and the drawing pad.

4. The stamping method according to claim 3, wherein the work piece is a joint piece made of two pieces: a first work piece composed of high tensile strength material and a second work piece composed of low tensile strength material, and in the mounting step, the work piece is mounted such that the first work piece is supported by the first supporting surface, and the second work piece is supported by the second supporting surface and the third supporting surface.

5. The stamping method according to claim 4, wherein prior to the bending step, a trimming step is executed for forming the profile of the first work piece into a required profile.

* * * * *